US008929798B2

(12) United States Patent
Tyler et al.

(10) Patent No.: US 8,929,798 B2
(45) Date of Patent: Jan. 6, 2015

(54) PRINT MEDIA TRAY

(71) Applicant: Hewlett-Packard Development Company, LP., Houston, TX (US)

(72) Inventors: Jerrod H. Tyler, Vancouver, WA (US); Kevin Lo, Vancouver, WA (US); Raymond C. Sherman, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 178 days.

(21) Appl. No.: 13/748,332

(22) Filed: Jan. 23, 2013

(65) Prior Publication Data

US 2014/0205354 A1 Jul. 24, 2014

(51) Int. Cl.

| | |
|---|---|
| ***G03G 15/00*** | (2006.01) |
| ***B65H 1/00*** | (2006.01) |
| ***B41J 11/00*** | (2006.01) |
| ***B41J 13/10*** | (2006.01) |

(52) U.S. Cl.

CPC ..... *B41J 11/006* (2013.01); *B41J 13/103* (2013.01)

USPC ..... 399/393; 271/9.09

(58) Field of Classification Search

CPC ..... B65H 1/00; B65H 1/04; G03G 15/00

USPC ..... 399/393; 271/9.09

See application file for complete search history.

(56) References Cited

U.S. PATENT DOCUMENTS

| | | | | |
|---|---|---|---|---|
| 4,605,215 | A * | 8/1986 | Hyltoft | 271/9.05 |
| 5,765,825 | A * | 6/1998 | Watase | 271/9.13 |
| 6,328,492 | B1 | 12/2001 | McKay et al. | |
| 6,474,884 | B2 | 11/2002 | Chiu | |
| 7,549,625 | B2 * | 6/2009 | Gotoh | 271/9.13 |
| 7,568,690 | B2 * | 8/2009 | Kurokawa et al. | 271/9.09 |
| 8,061,797 | B2 | 11/2011 | Mizutani | |
| 8,798,517 | B2 * | 8/2014 | Matsuyama et al. | 399/393 |
| 2004/0131384 | A1 * | 7/2004 | Miyaji et al. | 399/124 |
| 2009/0189343 | A1 * | 7/2009 | Hsu et al. | 271/277 |
| 2010/0166473 | A1 | 7/2010 | Asada et al. | |

FOREIGN PATENT DOCUMENTS

| | | | | |
|---|---|---|---|---|
| JP | 59194949 | A * | 11/1984 | G03G 15/00 |
| JP | 02163224 | A * | 6/1990 | B65H 3/00 |
| JP | 07149444 | A * | 6/1995 | B65H 1/26 |
| JP | 08108943 | A * | 4/1996 | G03G 15/00 |
| JP | 08245012 | A * | 9/1996 | G03G 15/00 |
| JP | 09301553 | A * | 11/1997 | H65H 3/00 |
| JP | 2001235993 | A * | 8/2001 | G03G 21/18 |
| JP | 2006151561 | A * | 6/2006 | B65H 1/70 |

OTHER PUBLICATIONS

West Hill Printers, "Brother HL-2040—Cover Removal," Oct. 27, 2011, 3 p. [Online] http://westhillprinters.blogspot.in/2011/10/brother-hl-2040-cover-removal.html.

(Continued)

*Primary Examiner* — Nguyen Ha

(57) ABSTRACT

A printer including a printer housing further including a cavity and a print media tray arranged to fit within the cavity. The print media tray further comprises a plurality of walls at least partially defining a receptacle a first roller support member disposed on one of the walls, outside of the receptacle; and a first roller disposed on the first roller support member

19 Claims, 8 Drawing Sheets

(56) References Cited

OTHER PUBLICATIONS

Wilson, A., "Epson Stylus Photo Printer PX820FWD Inkjet Printer Review," Sep. 28, 2010, 9 p.

Youtube.com, "Epson Stylus Photo PX710W Multifunction Printer Review," Oct. 20, 2009, 2 p. [Online] http://www.youtube.com/watch?v=PjBgbUPF-eQ&feature=fvsr.

* cited by examiner

PRINT MEDIA TRAY

BACKGROUND

Printers typically have multiple receptacles and/or loading features from which to draw print media from when performing print jobs. Due to this multiplicity, there are often multiple travel paths for the print media within the printer. If print media jams while being routed through one of these print media travel paths, it often becomes necessary to access the path in order to manually clear the jam. Clearing such jams is often cumbersome and difficult.

BRIEF DESCRIPTION OF THE DRAWINGS

For a detailed description of various examples of the invention, reference will now be made to the accompanying drawings in which.

NOTATION AND NOMENCLATURE

Certain terms are used throughout the following description and claims to refer to particular system components. As one skilled in the art will appreciate, computer companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct mechanical connection. Thus, if a first device couples to a second device, that connection may be through a direct connection, or through an indirect connection via other devices and connections.

DETAILED DESCRIPTION

The following discussion is directed to various examples of the invention. Although one or more of these examples may be preferred, the examples disclosed should not be interpreted, or otherwise used, as limiting the scope of the disclosure, including the claims. In addition, one skilled in the art will understand that the following description has broad application, and the discussion of any example is meant only to be descriptive of that example, and not intended to intimate that the scope of the disclosure, including the claims, is limited to that example.

Figure 1:
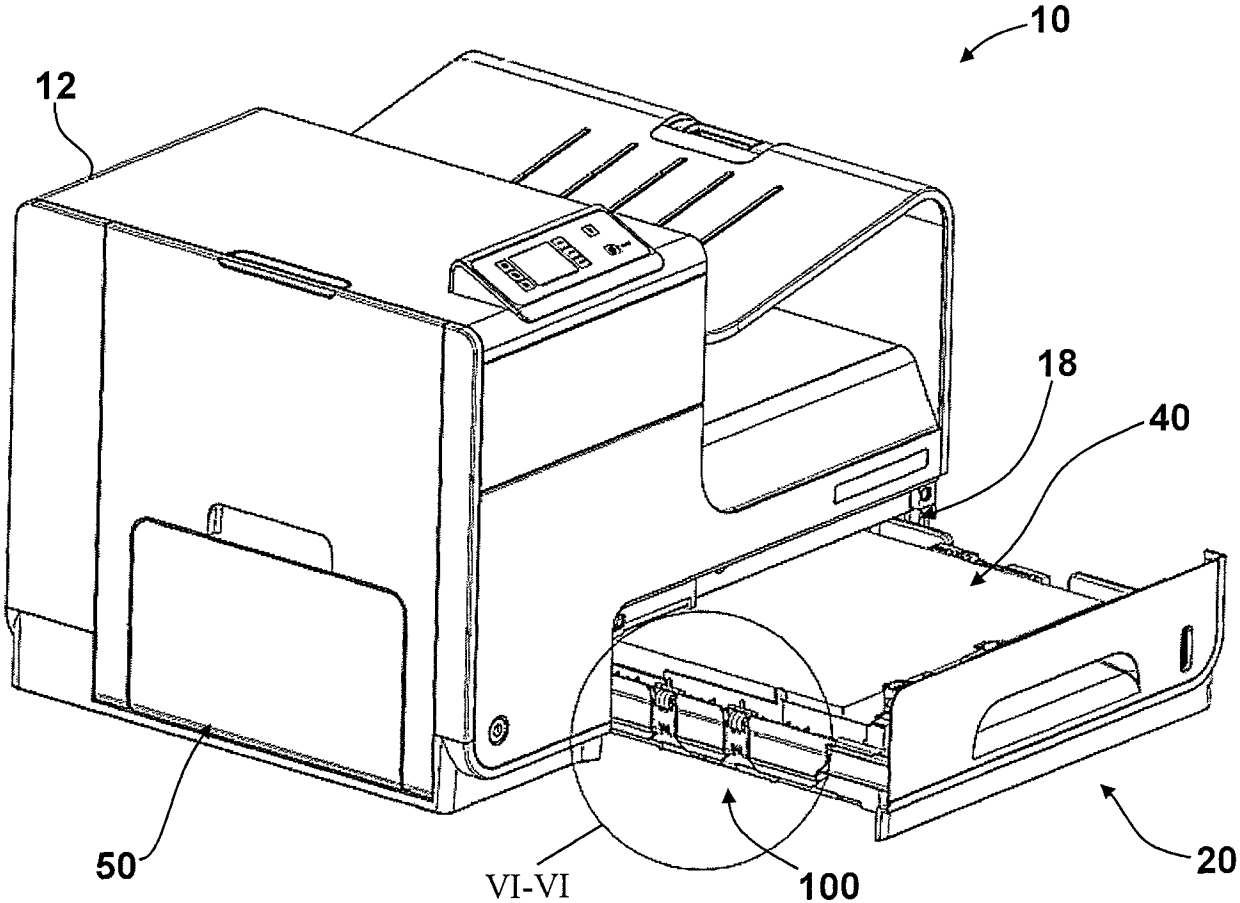
FIG. 1 shows a perspective view of a printer in accordance with the principles disclosed herein.
Figure 2:
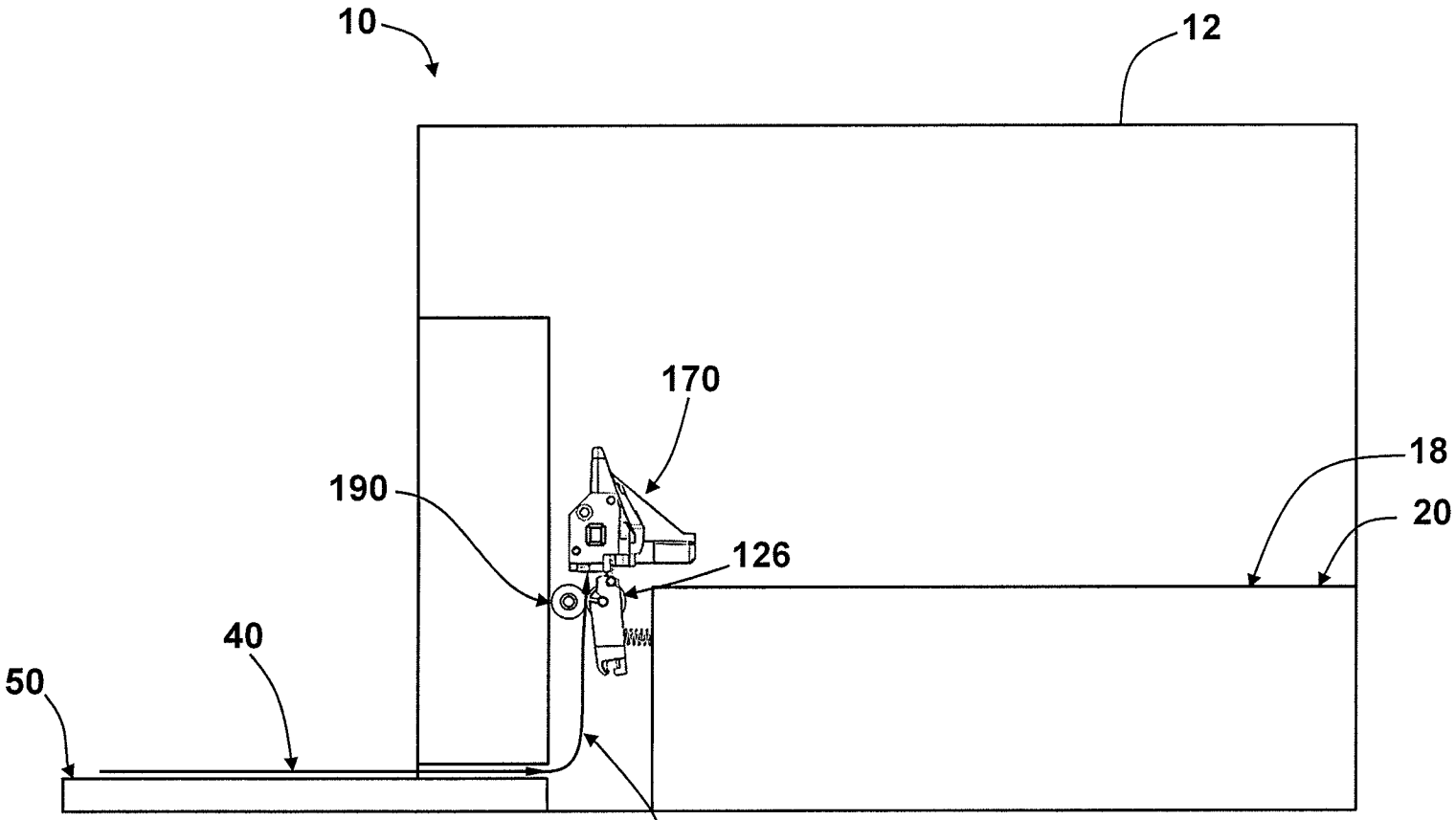
FIG. 2 shows a partially schematic cross-sectional view of the printer of FIG. 1 in accordance with the principles disclosed herein.

Referring now to FIGS. 1 and 2, wherein a printer 10 is shown. In general, printer 10 comprises a body or housing 12, a first print media storage tray 20, a second print media storage tray 50, and a track assembly 170 disposed within the housing 12. The first print media storage tray 20 is arranged to fit within a cavity 18 disposed within the housing 12 and to hold or receive a plurality of sheets of print media 40. The second print media storage tray 50 is disposed along the housing 12 and, like the tray 20, is also arranged to hold or receive a number of sheets of print media 40. As is best shown in FIG. 2, print media 40 which is routed from the second printer media tray 50 travels along a print media travel path 55 within the printer 10. At one point, path 55 passes adjacent to the tray 20 within the printer 10 such that print media 40 is directed between a drive roller 190 and a roller 126. The drive roller 190 is driven to rotate via a driving device (not shown) such as, for example, a motor. The roller 126 is driven to rotate via contact with the drive roller 190, thereby allowing media 40 to be pinched between the rollers 190, 126 and driven or directed to other parts or portions of the printer 10, along path 55.

Figure 3:
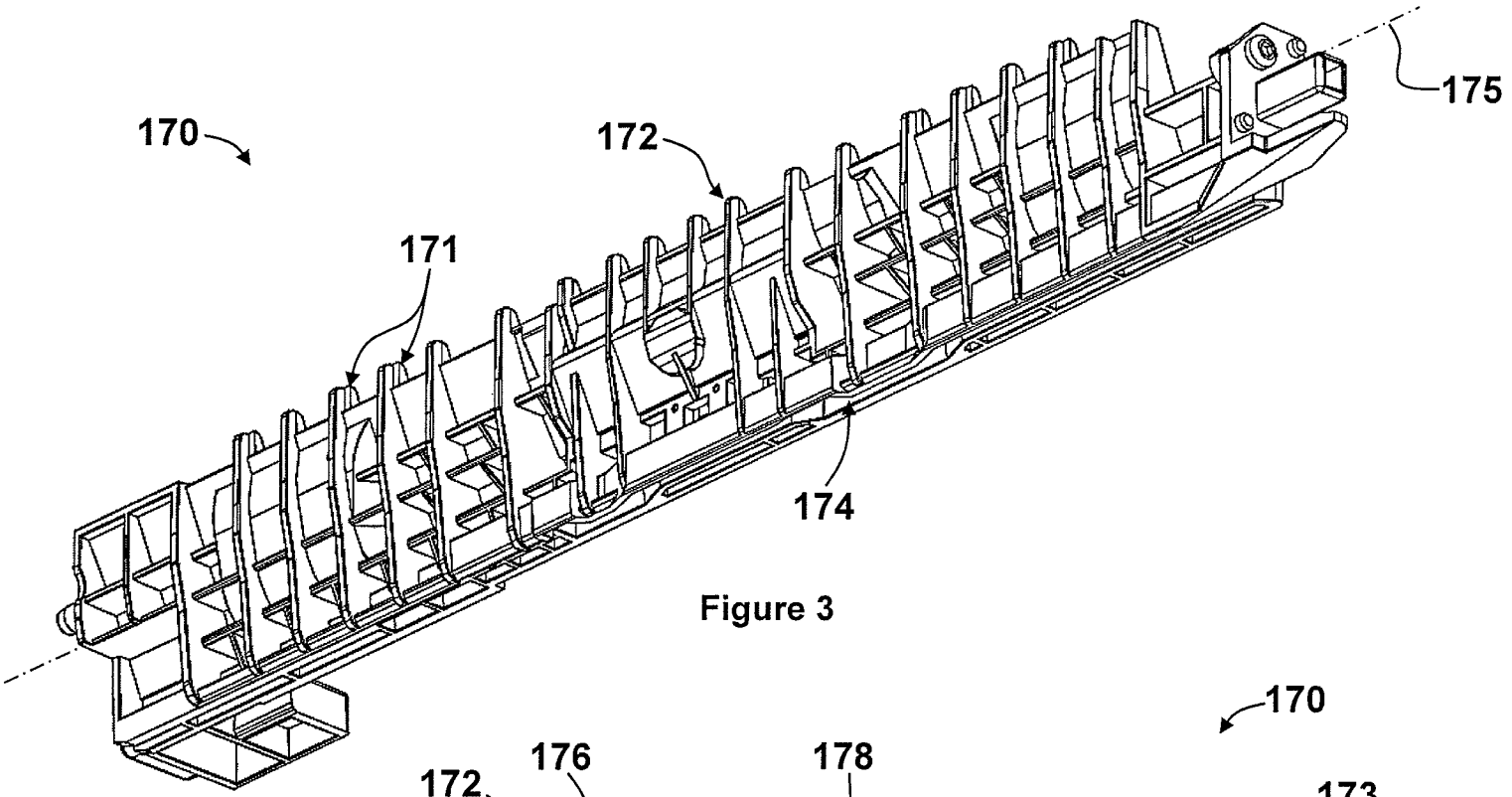
FIG. 3 shows a perspective view of a track assembly which is disposed within the printer of FIG. 1 in accordance with the principles disclosed herein.
Figure 4:
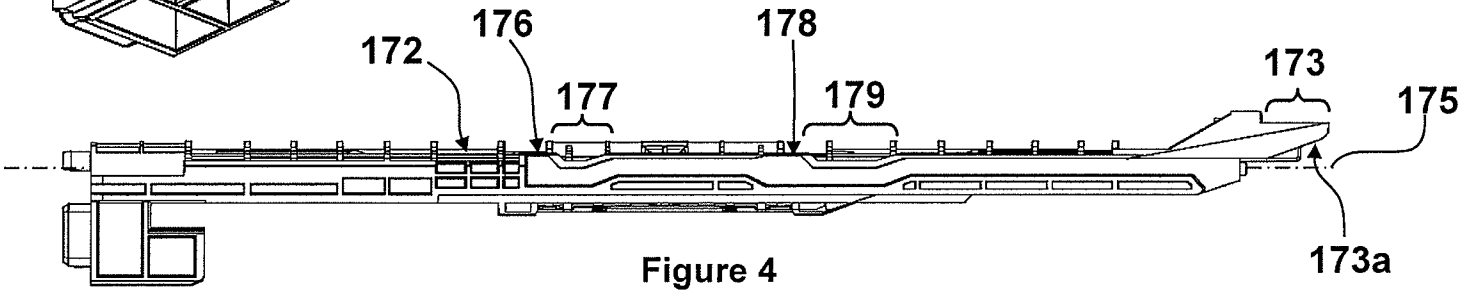
FIG. 4 shows a bottom view of the track assembly of FIG. 3 in accordance with the principles disclosed herein.

Referring now to FIGS. 2-4, as previously described, track assembly 170 is disposed within the cavity 18 of printer 10, adjacent the tray 20. In general, track assembly 170 comprises a longitudinal axis 175, a frame 172, and a track 174. Frame 172 is arranged to be mounted or secured within the cavity 18 disposed in housing 12 of the printer 10 by any suitable means. For example, frame 172 may be mounted with the cavity 18 via screws, bolts, snaps, an adhesive, or some combination thereof while still complying with the principles disclosed herein. A plurality of frame members 171 is disposed on the frame 172. As will be described in more detail below, the frame members 171 partially define a portion of the print media travel path 55 within the printer 10 when the track assembly 170 is disposed within the cavity 18. Track 174 is oriented such that it is substantially parallel to the axis 175, and, as is best shown in FIG. 4, includes a first aligned section 176, a second aligned section 178, a first deflected section 177, a second deflected section 179, and a feeding ramp 173. As is shown in FIG. 4, the first and second deflected sections 177, 179, respectively, are substantially parallel with and radially offset from the first and second aligned sections 176, 178, respectively. The feeding ramp 173 generally comprises a ramped surface 173*a*, which, as will be described in more detail below, provides an entrance or exit to the track 174 during insertion or withdrawal of the tray 20 from the cavity 18.

Figure 5:
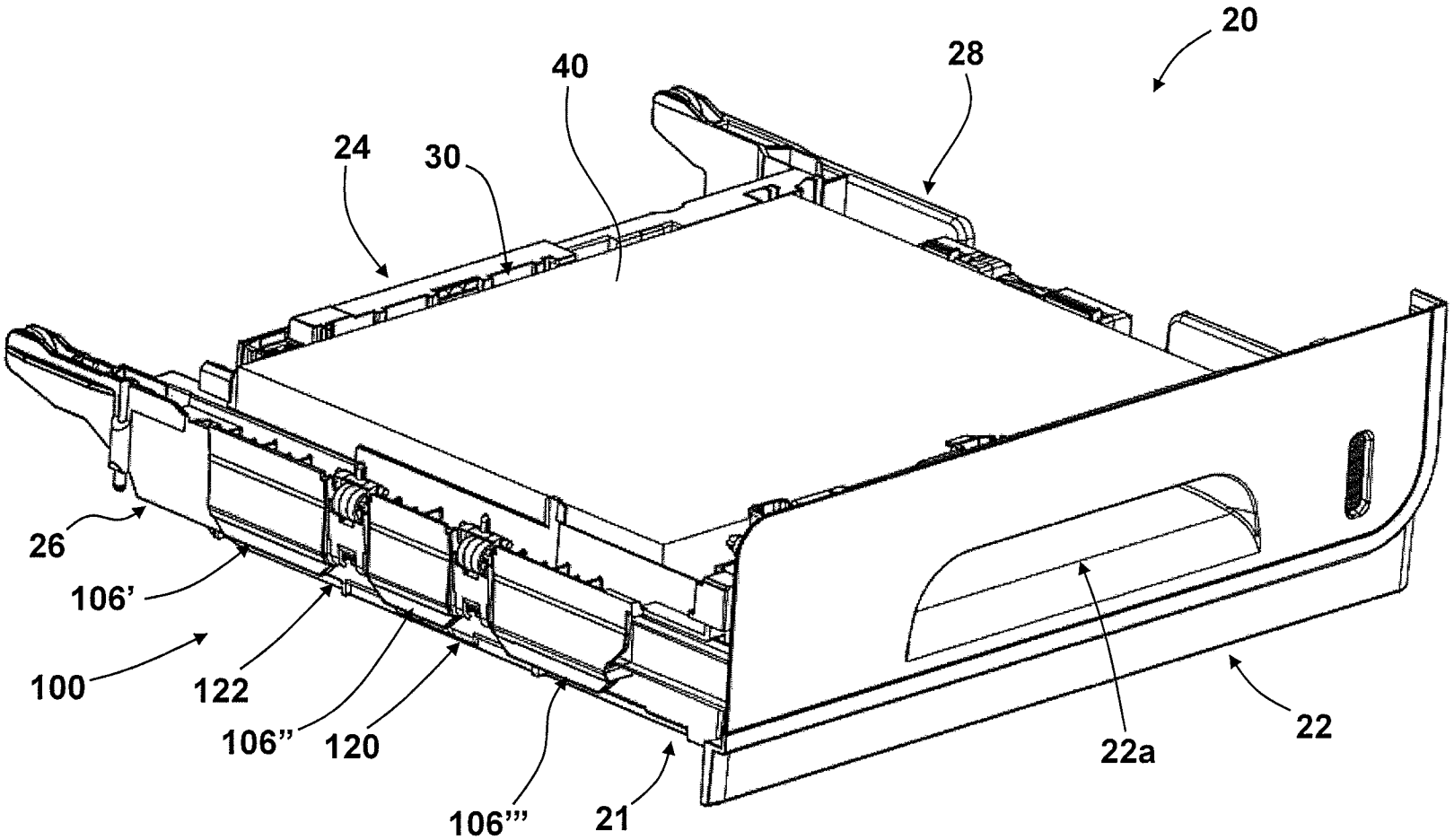
FIG. 5 shows a perspective view of a print media storage tray which is disposed within the printer of FIG. 1 in accordance with the principles disclosed herein.

Referring now to FIG. 5, tray 20 generally comprises a base 21, a front side 22, a rear side 24 opposite the front side 22, a first lateral side 26, a second lateral side 28 opposite the first lateral side 26, and a print media roller assembly 100 disposed on the first lateral side 26. The base 21 and the sides 22, 24, 26, and 28 all define a receptacle 30 which is arranged to hold or receive a number of sheets of print media 40. The front side 22 includes a handle 22*a*, which is arranged such that a user or operator (not shown) of the printer may grasp the tray 20, via the handle 22*a*, in order to either withdrawal or insert the tray 20 from or into the printer 10, respectively.

Figure 6:
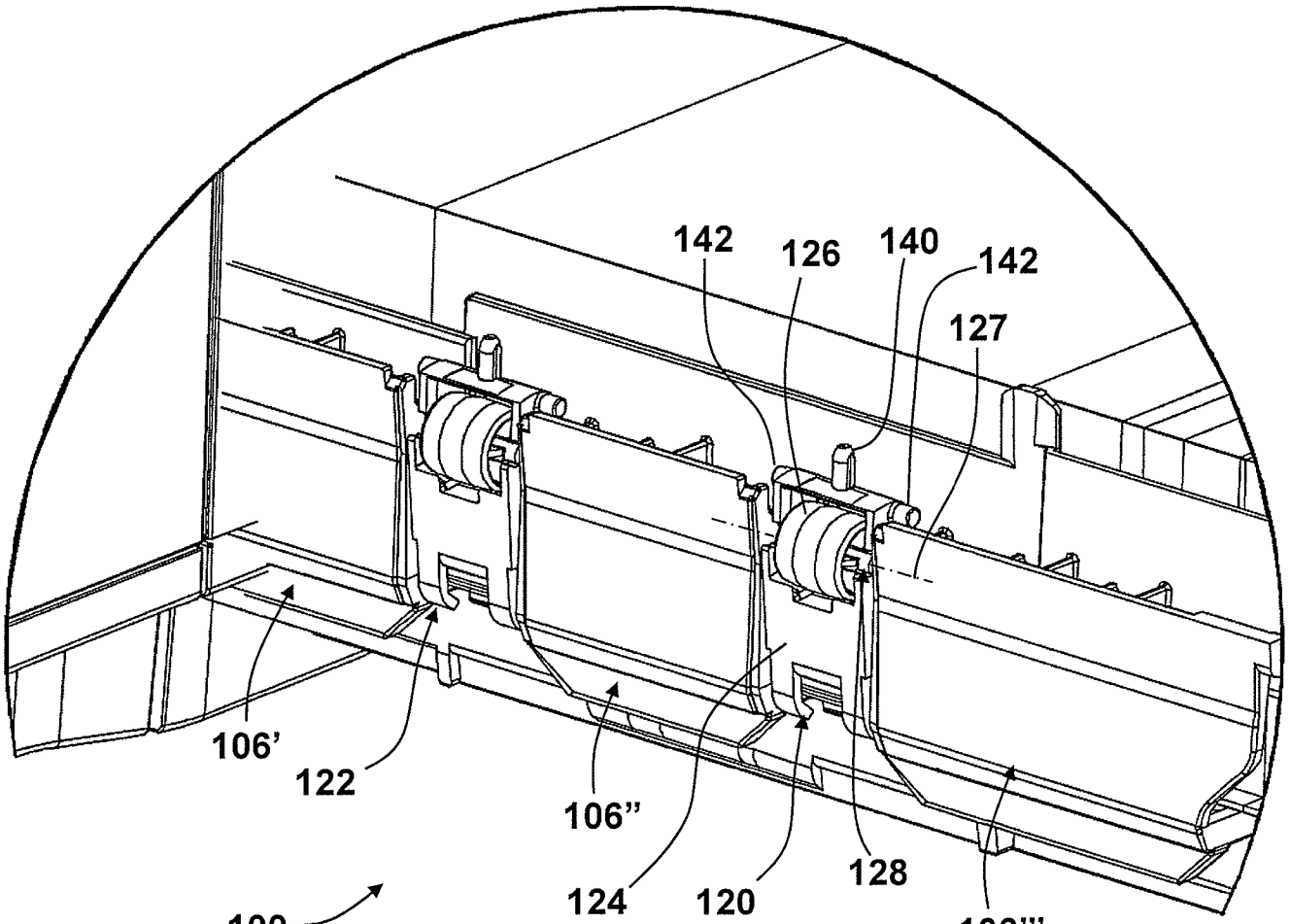
FIG. 6 shows an enlarged perspective view of section VI-VI of FIG. 1 illustrating a print media roller assembly disposed on the print media storage tray in accordance with the principles disclosed herein.
Figure 7:
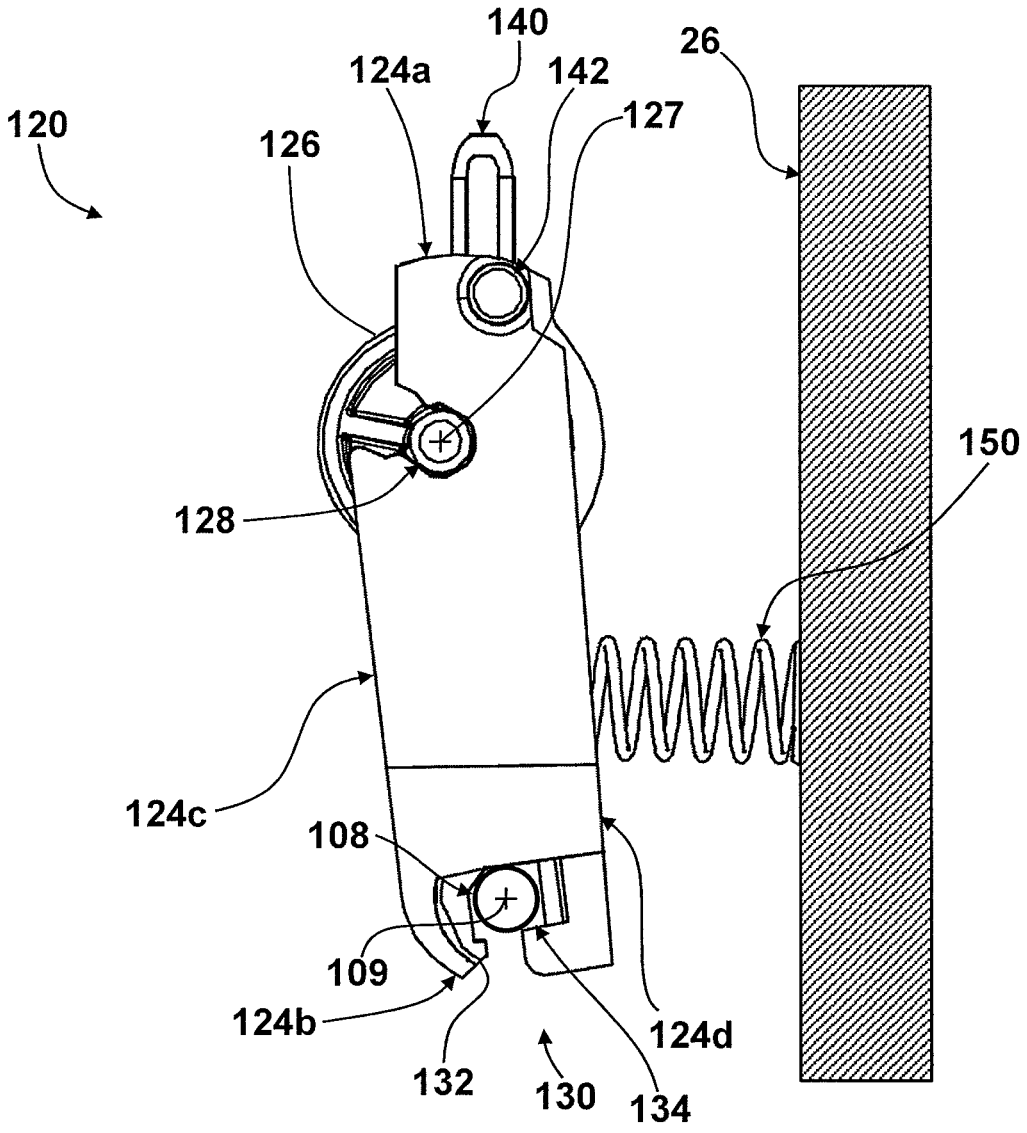
FIG. 7 shows a partially schematic side view of one of the roller support members disposed on the print media roller assembly of FIG. 6 in accordance with the principles disclosed herein.

Referring now to FIGS. 5-7, print media roller assembly 100 comprises a first roller support member 120, a second roller support member 122, and a plurality of ramped surfaces 106. In this example, three ramped surfaces 106 are shown. For purposes of clarity, the ramped surface 106 proximate the rear facing side 24 of the tray 20 will be designated herein as 106', the ramped surface 106 disposed between the first and second roller support members 120, 122, respectively, will be designated herein as 106", and the ramped surface 106 that is proximate the front facing side 22 of tray 20 will be designated herein as 106'''. Each of the roller support members 120, 122 are disposed between two ramped surfaces 106 along the first lateral side 26. In particular, the first roller support member 120 is positioned between the ramped surfaces 106" and 106''', while the second roller support member 122 is disposed between the ramped surface 106' and 106". As will be described in more detail below, ramped surfaces 106', 106", 106''' define a portion of the print media travel path 55 within printer 10 when tray 20 is fully installed therein.

Referring now to FIGS. 6 and 7, wherein the roller support members 120, 122 disposed on the first lateral side 26 are shown. In this example, each of the roller support members 120, 122 are substantially identical. Therefore, a description of the member 120 also applies to fully describe the member 122. Thus, for purposes of conciseness, a separate description of the member 122 has been omitted. In general, roller support member 120 includes a body or frame 124, and a roller 126 supported within the frame 124. Roller 126 further includes a roller shaft 128 which is oriented along an axis of rotation 127 and rotatably coupled to the frame 124. As previously described, roller 126 is arranged to rotate about the axis 127 in order to assist in advancing print media 40 within the printer 10, along the print media travel path 55.

As is best shown in FIG. 7, frame 124 generally comprises a first or upper end 124*a*, a second or lower end 124*b* opposite the upper end 124*a*, a first or front facing side 124*c*, and a second or rear facing side 124*d*. The lower end 124*b* includes an engagement assembly 130, which further includes a receptacle 134 and an engagement member 132. A connecting shaft 108 extends from ramped surface 106" to ramped surface 106''' (surfaces 106", 106''' are not shown in FIG. 7), along an axis 109, which is radially offset and substantially parallel to the axis 127. Frame 124 engages with the shaft 108 via the engagement assembly 130. In particular, the shaft 108 is received within the receptacle 134 and secured therein via the engagement member 132, thus allowing frame 124 to rotate about the axis 109. The upper end 124*a* includes an engagement pin 140 extending therefrom in a direction that is substantially orthogonal or perpendicular to the axes 127 and 109. As will be described in more detail below, pin 140 is arranged to engage with and travel along track 174 when the tray 20 is installed within the cavity 18 of printer 10. Additionally, a pair of alignment members 142 is disposed on the frame 124 such that each member 142 extends outwardly a direction that is substantially parallel to the axes 127 and 109.

A biasing member 150 (e.g., a spring) is disposed between the first lateral surface 26 of the tray 20 and the rear facing surface 124*d* of the frame 124 such that the frame 124 is driven to rotate about the shaft 108 via member 150. As the frame 124 is rotated about the shaft 108, the roller 126 is biased away from the first lateral side 26 (i.e., toward the left in FIG. 7). Further, and as is best shown in FIG. 6, the roller 126 is biased outward, via the biasing member 150 (not shown in FIG. 6), such that the alignment members 142 contact and engage with the ramped surfaces 106", 106''' when the tray 20 is completely withdrawn from the printer 10. However, it should be appreciated that in at least some examples, the members 142 do not engage the ramped surfaces 106", 106''' when the printer 20 is fully inserted within the cavity 18 of printer 10. In this example, biasing member 150 is a coiled spring. However, it should be appreciated that, in other examples, any other known biasing member 150 may be used while still complying with the principles disclosed herein. For example, in some implementations, biasing member 150 may be a torsional spring disposed about the shaft 108. As will be described in more detail below, the biasing member 150 ensures that the roller 126 maintains sufficient contact with the drive roller 190 when the tray 20 is fully installed within the cavity 18 of printer 10.

Figure 8:
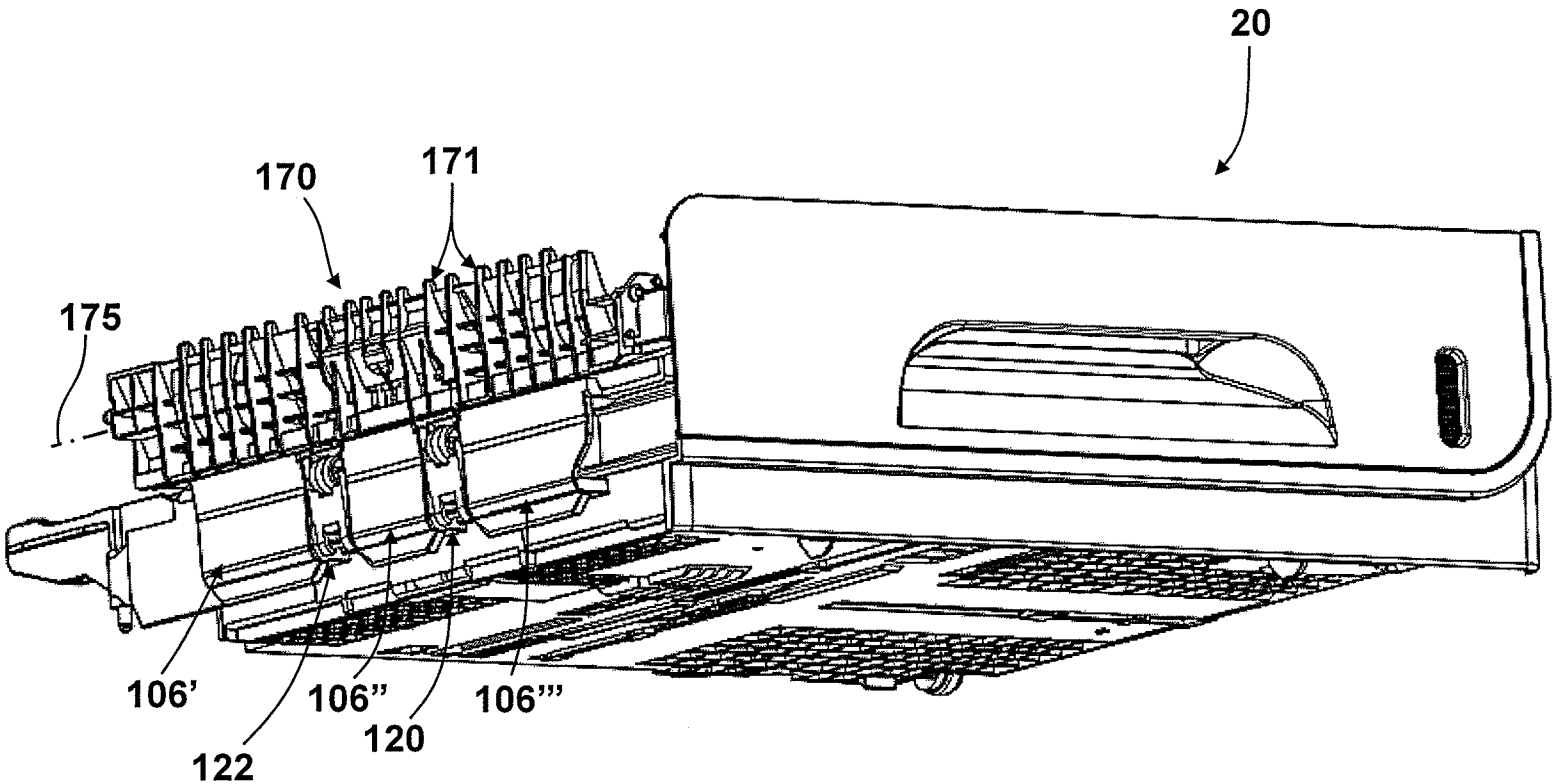
FIG. 8 shows a perspective view of the tray of FIG. 5 engaged with the track assembly of FIG. 3 in accordance with the principles disclosed herein.

Referring now to FIGS. 2 and 8, when tray 20 is installed within the cavity 18 of printer 10, the engagement pins 140 disposed on the roller support members 120, 122 engage with and slide along the track 174. In particular, as tray 20 is advanced into the cavity 18 along the axis 175 the pins 140 initially engage with the ramped surface 173*a* on feeding ramp 173 (FIG. 4) and then traverse along track 174. When tray 20 is fully installed within printer 10, the ramped surfaces 106', 106", 106''' are aligned with the plurality of frame members 171 disposed on the frame 172 of track assembly 170, thereby partially defining the print media travel path 55.

Figure 9:
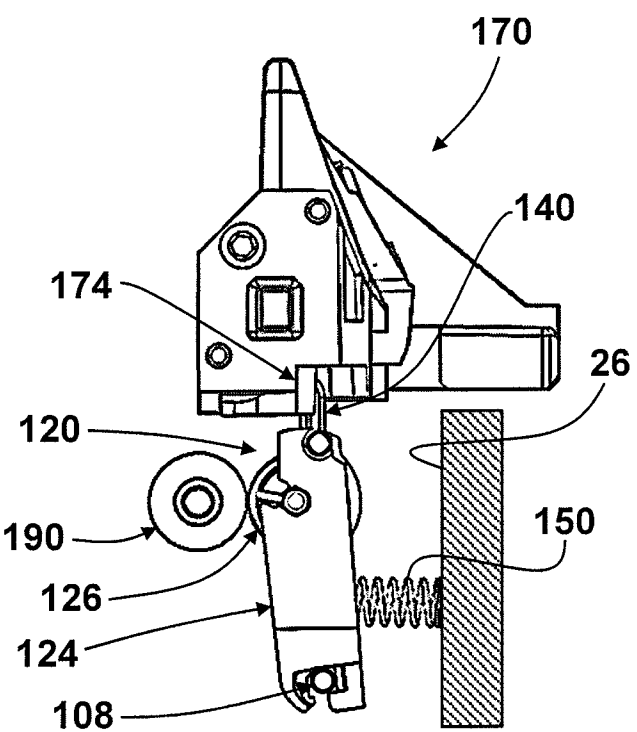
FIG. 9 shows a partially schematic side view of one of the roller support members of FIG. 7 engaged with the track assembly of FIG. 3 in accordance with the principles disclosed herein.

Referring now to FIGS. 2, 4, and 9, when the tray 20 is fully installed or inserted within the cavity 18 of printer 10, the engagement pins 140 of the roller support members 120, 122 are disposed within the aligned sections 176, 178 of track 174. In particular, the engagement pin 40 of the second roller support member 122 is disposed within the first aligned section 176 of the track 174, while the engagement pin 140 of the roller support member 120 is disposed within the second aligned section 178 of the track 174. When the pins 140 are disposed within the first and second aligned sections 176, 178, respectively, the rollers 126 are biased into engagement with drive rollers 190 disposed within the body 12 of the printer 10. It should be appreciated that while only one drive roller 190 and the first roller support assembly 120 are shown in FIG. 9, the second roller support assembly 122 is arranged in substantially the same manner within track 174.

Figure 10:
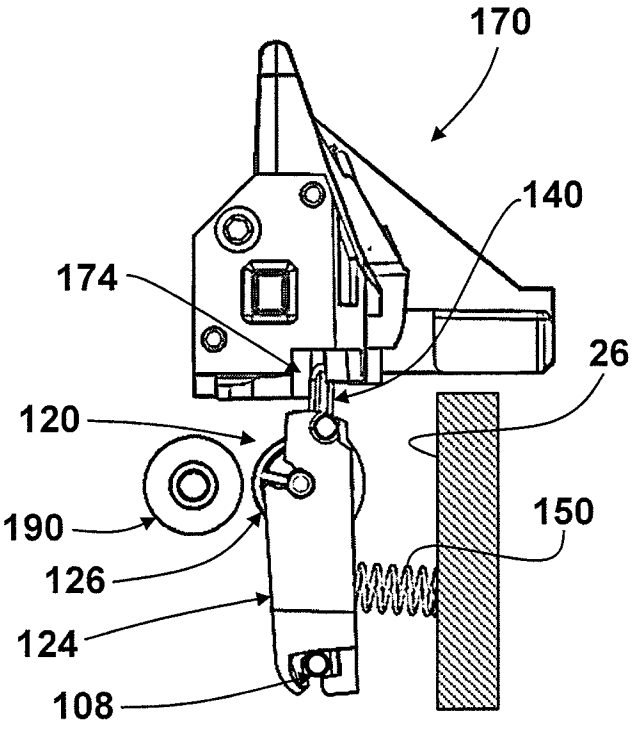
FIG. 10 shows a partially schematic side view of one of the roller support members of FIG. 7 engaged with the track assembly of FIG. 3 in accordance with the principles disclosed herein.

Referring now to FIGS. 2, 4, and 10, when tray 20 is withdrawn from the cavity 18 of printer 10, the pins 140 on the roller support members 122, 120 enter the deflected sections 177, 179 of track 174. In particular, the engagement pin 40 of the second roller support member 122 enters the first deflected section 177, while the engagement pin 40 of the first roller support member 120 enters the second deflected section 179. When the pins 140 are disposed within the first and second deflected sections 177, 179, respectively, the rollers 126 of the first and second roller support members 120, 122, respectively, are deflected toward the first lateral side 26 of tray 20 (i.e., toward the right in FIG. 10), such that rollers 126 disengage from the drive rollers 190. Once the rollers 126 on the first and second roller support members 120, 122, respectively, disengage from the drive rollers 190, the tray 20 is more easily withdrawn from the cavity 18 in printer 10, and the print media travel path 55 is directly accessible through the cavity 18. As is previously described above for FIG. 9, while only one drive roller 190 and the first roller support member 120 are shown in FIG. 10, it should be appreciated that the second roller support member 122 is arranged in substantially the same manner within track 174.

Thus, through use of print media support assembly 100 on tray 20, a user or operator of the printer 10 may be able to access the print media travel path 55 within the printer 10 by simply removing the tray 20 from the cavity 18. As a result, removal of jammed sheets of print media 40 is greatly simplified and requires few steps to accomplish.

While examples disclosed herein have shown and described the print media roller assembly 100 on the first lateral side 26 of the print media storage tray 20, in some examples, assembly 100 may be disposed on one of the other sides (e.g., side 28 or side 24) of tray 20 while still complying with the principles disclosed herein. Also, while examples disclosed herein have shown and described three ramped surfaces 106 along the first lateral side 26 of the tray 20, in other examples, more or less than three ramped surfaces 106 may be included. For example, in some examples only one ramped surface 106 may be included, while in other examples, more than three ramped surfaces 106 may be included while still complying with the principles disclosed herein. Also, while the track 174 has been described and shown herein as having aligned sections 176, 178 and deflected sections 177, 179 that are offset and substantially parallel to one another, in other examples, the deflected sections 177, 179 may not be substantially parallel to the aligned sections 176, 178 while still complying with the principles disclosed herein. Further, while the roller support members 120, 122 have been described and shown as being identical, in other examples, roller support members 120, 122 may be not identical, and may have slightly different designs. Still further, while examples disclosed herein have included two roller support members 120, 122, in other examples, the print media roller assembly 100 may include more or less than two roller support members, while still complying with the principles disclosed herein. Still further, in some examples, shaft 108 may not extend between adjacent pairs of ramped surfaces 106 (e.g., between surfaces 106" and 106'") as is described herein, and instead, the shaft 108 may be coupled to the first lateral side 26 in some other suitable fashion. Still further, in other example, the specific geometry of track 174 may be altered from that described above while still complying with the principles disclosed herein.

The above discussion is meant to be illustrative of the principles and various examples of the present invention. Numerous variations and modifications will become apparent to those skilled in the art once the above disclosure is fully appreciated. It is intended that the following claims be interpreted to embrace all such variations and modifications.

What is claimed is:

1. A printer, comprising:

a printer housing including a cavity;

a print media tray to fit within the cavity, wherein the print media tray comprises a plurality of walls at least partially defining a receptacle;

a first roller support member disposed on one of the walls and outside of the receptacle, the first roller support member including a pin extending therefrom;

a first roller disposed on the first roller support member;

a print media travel path;

a second roller disposed along the print media travel path, the second roller to be disengaged from the first roller when the print media tray is not installed within the cavity and to be engaged with the first roller when the print media tray is installed within the cavity; and a track disposed within the printer housing, wherein the pin is to engage with the track.

2. The printer of claim 1, wherein the first roller is biased to engage with the second roller.

3. The printer of claim 2, wherein the first roller is biased with a spring.

4. The printer of claim 2, further comprising at least one ramped surface disposed adjacent to the first roller support member, wherein the at least one ramped surface at least partially defines the print media path.

5. The printer of claim 2, further comprising:

a second roller support member disposed adjacent the first roller support member on one of the walls, outside of the receptacle; and a third roller disposed on the second roller support member; and a fourth roller disposed along the print media travel path and to engage the third roller;

wherein engagement between the third roller and the fourth roller is caused by installing the print media tray within the cavity.

6. The printer of claim 1, wherein the track has a first section and a second section;

wherein the second section is offset from the first section;

wherein the first roller is to engage with the second roller when the pin is in the first section; and wherein the first roller is to disengage from the second roller when the pin is in the second section.

7. The printer of claim 1, further comprising:

a second print media tray, wherein, when the first print media tray is installed in the printer, the second roller is to be engaged with the first roller to permit feeding media from the second print media tray.

8. The printer of claim 7, wherein the print media travel path for the first print media tray and a print media travel path for the second print media tray both pass by the first and second rollers.

9. The printer of claim 7, wherein the first print media tray is to be removed from the printer in a first direction and the second print media tray is to be removed from the printer in a second direction, the first and second directions being perpendicular to each other.

10. The printer of claim 1, wherein the pin is to travel along the track to an aligned section of the track, and wherein the second roller is to be engaged with the first roller when the pin is disposed in the aligned section of the track.

11. The printer of claim 1, wherein the track is part of a track assembly that partially defines the print media travel path.

12. A printer tray, comprising:

a plurality of walls;

a receptacle defined at least partially by the walls;

a first roller support member disposed on one of the walls and outside of the receptacle, the first roller support member including a pin extending therefrom wherein the pin is to engage with a track of a printer that receives the printer tray; and a first roller disposed within the first roller support member, wherein the first roller is to be disengaged from a second roller when the printer tray is not installed in the printer and to be engaged with the second roller when the printer tray is installed in the printer.

13. The printer tray of claim 12, wherein the first roller is biased into engagement with the second roller.

14. The printer tray of claim 13, wherein the first roller is biased with a spring.

15. The printer tray of claim 12, further comprising at least one ramped surface disposed adjacent the first roller support member.

16. The printer tray of claim 15, wherein the at least one ramped surface at least partially defines a print media travel path.

17. The printer tray of claim 12, further comprising:

a second roller support member disposed adjacent the first roller support member on one of the walls and outside of the receptacle; and a third roller disposed on the second roller support member.

18. A printer, comprising:

a first print media tray to be disposed within the printer, the first print media tray comprising:

a plurality of walls;

a receptacle defined at least partially by the walls;

a first roller support member disposed on one of the walls and outside of the receptacle, the first roller support member including a pin extending therefrom; and a first roller disposed within the first roller support member;

a second print media tray dispose within the printer;

a print media travel path extending from the second tray;

a second roller disposed along the print media travel path, the second roller to be disengaged from the first roller when the print media tray is not disposed in the printer and to be engaged with the first roller when the print media tray is disposed in the printer; and a track disposed within the printer, wherein the pin is to engage with the track.

19. The printer of claim 18, further comprising:

a second roller support member disposed adjacent the first roller support member on one of the walls, outside of the receptacle;

a third roller disposed on the second roller support member; and a fourth roller disposed along the print media travel path;

wherein the third roller is biased into engagement with the fourth roller.

* * * * *